US008642955B2

(12) United States Patent
Austin et al.

(10) Patent No.: US 8,642,955 B2
(45) Date of Patent: Feb. 4, 2014

(54) TOROIDAL ION TRAP MASS ANALYZER WITH CYLINDRICAL ELECTRODES

(75) Inventors: Daniel E. Austin, Mapleton, UT (US); Nicholas R. Taylor, Richland, WA (US)

(73) Assignee: Brigham Young University, Provo, UT (US)

( * ) Notice: Subject to any disclaimer, the term of this patent is extended or adjusted under 35 U.S.C. 154(b) by 0 days.

(21) Appl. No.: 13/589,988

(22) Filed: Aug. 20, 2012

(65) Prior Publication Data

US 2013/0214152 A1 Aug. 22, 2013

Related U.S. Application Data

(60) Provisional application No. 61/575,295, filed on Aug. 18, 2011, provisional application No. 61/634,027, filed on Feb. 22, 2012.

(51) Int. Cl.
*H01J 49/22* (2006.01)

(52) U.S. Cl.
USPC ..... 250/292; 250/281; 250/282; 250/290; 250/291; 250/396 R; 250/397; 250/396 ML

(58) Field of Classification Search
USPC ..... 250/281, 282, 286, 287, 288, 290, 291, 250/292, 294, 298, 299, 396 R, 397, 398, 250/400, 396 ML
See application file for complete search history.

(56) References Cited

U.S. PATENT DOCUMENTS

| | | | |
|---|---|---|---|
| 6,838,666 | B2 | 1/2005 | Ouyang et al. |
| 7,872,228 | B1 | 1/2011 | Kim et al. |
| 2003/0089846 | A1 | 5/2003 | Cooks et al. |
| 2004/0149903 | A1 | 8/2004 | Wang |
| 2008/0017794 | A1 | 1/2008 | Verbeck |
| 2008/0128605 | A1 | 6/2008 | Wells et al. |

*Primary Examiner* — Robert Kim
*Assistant Examiner* — Hanway Chang
(74) *Attorney, Agent, or Firm* — Morriss O'Bryant Compagni, PC

(57) ABSTRACT

A combination of electrodes that are cylindrical and an asymmetric arrangement of cylindrical and planar electrodes are used to create electric fields that compensate for toroidal curvature in a toroidal ion trap, the design lending itself to high precision manufacturing and miniaturization, converging ion paths that enhance detection, higher pressure operation, and optimization of the shape of the electric fields by careful arrangement of the electrodes.

33 Claims, 13 Drawing Sheets

TOROIDAL ION TRAP MASS ANALYZER WITH CYLINDRICAL ELECTRODES

CROSS REFERENCE TO RELATED APPLICATIONS

This document claims priority to and incorporates by reference all of the subject matter included in the provisional patent application having Ser. No. 61/575,295, filed Aug. 18, 2011, and provisional patent application having Ser. No. 61/634,027, filed Feb. 22, 2012.

BACKGROUND OF THE INVENTION

1. Field of the Invention

This invention relates generally to a toroidal ion trap mass analyzer that may be used in the creation, storage, separation and analysis of ions according to mass-to-charge ratios of changed particles and charged particles derived from atoms, molecules, particles, sub-atomic particles and ions. More specifically, the present invention is a novel design of the toroidal ion trap mass analyzer that may be easier and less expensive to manufacture, lends itself to miniaturization, and performs as well or better than existing toroidal ion trap designs.

2. Description of Related Art

Mass spectrometry continues to be an important method for identifying and quantifying chemical elements and compounds in a wide variety of samples. High sensitivity and selectivity of mass spectrometry are especially useful in threat detection systems (e.g. chemical and biological agents, explosives) forensic investigations, environmental on-site monitoring, and illicit drug detection/identification applications, among many others. Thus, the need for a reliable mass analyzer that can perform in-situ makes a portable device even more relevant. Some key elements in developing portable mass spectrometers are reduction in size, weight and power consumption, along with reduced support requirements and cost.

Ion trap analyzers are inherently small, even as implemented commercially. Ion trap analyzers also have only a few ion optic elements, which do not require highly precise alignment relative to other types of mass analyzers. In addition, because they are trapping devices, multiple stages of mass spectrometry (MS) can be performed in a single mass analyzer. The operating pressure for ion traps is higher than other forms of mass spectrometry allowing for less stringent pumping requirements. Furthermore, because the radio frequency (RF) trapping voltage is inversely proportional to the square of the analyzer radial dimension, a modest decrease in analyzer size results in a large reduction in operating voltage. This in turn results in lower power requirements. An added potential benefit of the reduced analyzer size is the shorter ion path length which may ease the vacuum requirements even further. As a practical matter, the shorter ion path length is especially important as some of the most limiting aspects of MS miniaturization are not in the ion optic components, but rather in the vacuum and other support assemblies.

FIG. 1 is a perspective view of a toroidal ion trap 10 as found in the prior art. FIG. 2 is a cross-sectional view of the toroidal ion trap 10 of FIG. 1. Notice that the outer ring assembly 12 and the inner ring assembly 14 are hyperbolic surfaces, as well as the end-caps. These hyperbolic surfaces are difficult to machine in small dimensions. The trapping volume is shown as the dotted circle 16. The trapping volume 16 becomes a circular ring when seen from above as the toroidal ion trap 10 is rotated around a central axis 18.

The toroidal ion trap suffers from several inherent field defects. Field defects are irregularities or non-uniformities in the electric fields generated in toroidal ion traps that make it difficult or impossible to make electrical fields that are perpendicular to ion motion at all values of z (the axial variable) during axial ion ejection. The result is that as ions are ejected they are also pushed in radial directions, distorting the ion packet and compromising either sensitivity, resolution, or both.

The problem above is illustrated in FIGS. 3A and 3B. In FIG. 3A, the electrodes 20 and 22 are shown as being symmetric. The problem is that the ejection path 24 for ions is not along a path 26 that is perpendicular to the electric field shown as field lines 28. The ions are being directed into the walls of the toroidal ion trap 10 instead of along the desired ejection path 24 that leads to a detector (not shown).

The hyperbolic electrode surfaces in FIG. 3B are required to correct the shape of the electric fields in order to have ejection of ions in a desired direction. Furthermore, the electrodes do not even have the same hyperbolic shape. It is also noted that the RF electrode end-caps also have hyperbolic surfaces.

Another problem with conventional toroidal ion traps is that the hyperbolae of revolution are quite complex. This complexity makes the toroidal ion trap difficult to machine. This difficulty gets even harder when done on a small scale, making them hard to miniaturize.

There are several advantages over existing ion traps when using a miniaturized design. First, there is a relaxed vacuum requirement. The result is reduced pump power needed to create the vacuum inside the toroidal ion trap. Another advantage is the reduced instrument power required to operate the toroidal ion trap. Another advantage is the reduced weight which is especially important in mobile or field applications. Thus, the desire to miniaturize a toroidal ion trap raises the issue of how to simplify the design so that a miniature toroidal ion trap can be more easily manufactured than current hyperbolic electrode designs.

It is also important to understand that as these devices become smaller, the machining tolerances play an increasingly significant role in trapping field defects. Thus, it would be an advantage over the prior art to simplify the geometry of the walls that function as electrodes to have a design that is more easily machined.

Cylindrical ion trap mass analyzers 40 as shown in FIG. 4 have been miniaturized because the simplified, straight lines or a cylinder are considerably easier to machine than hyperbolic surfaces, especially in small dimensions. When the geometry of the ion trap electrodes deviates significantly from the theoretical geometry, as is the case for cylindrical ion traps 40, corrections are needed to restore the trapping field potentials to their theoretical values. Modeling and simulation programs have been used extensively in this undertaking.

Disadvantageously, the gains from reducing analyzer size (e.g. increased portability due to lower weight and smaller size, lower RF generator power, and relaxed vacuum requirements) are understandably offset by a reduction in ion storage capacity in state of the art mass analyzers.

Attempts have been made to recover the lost ion storage capacity in miniaturized ion trap designs. For example, arraying several reduced volume cylindrical ion traps is one approach. More recently, linear ion traps with either radial or axial ejection have also been developed. The increased ion storage capacity is due to the volume available throughout the length of the two-dimensional quadrupole rod array. These devices are now readily available in commercial versions.

Toroidal ion traps cannot easily be reduced further in size without deterioration in electric field shape and its corresponding performance. Using cylindrical-shaped electrodes to approximate a toroidal ion trap would seem to be an obvious approach to miniaturization, but it cannot be done in an obvious manner due to fundamental hyperbolic electrode shapes that exists in conventional toroidal ion trap designs.

The toroidal ion trap geometry offers some unique advantages as a miniature mass analyzer if it can be designed. All ions are contained within a single trapping field so, unlike arrays, there is no concern in matching the individual arrays or in interfacing ion sources or detectors to ensure equal illumination or sampling from each cell of the array. In fact, the circular form offers a compact geometry which can be easily interfaced to ionizers and electron multiplier detectors.

Finally, in contrast to conventional linear quadrupole ion traps, the trapping field is homogeneous throughout the entire trapping volume (i.e. there are no end effects because the trapping volume is annular) and all ions of a given mass-to-charge ratio (m/z) are simultaneously ejected.

BRIEF SUMMARY OF THE INVENTION

The present invention uses combination of electrodes that are cylindrical and an asymmetric arrangement of cylindrical and planar electrodes are used to create electric fields that compensate for toroidal curvature in a toroidal ion trap, the design lending itself to high precision manufacturing and miniaturization, converging ion paths that enhance detection, higher pressure operation, and optimization of the shape of the electric fields by careful arrangement of the electrodes.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
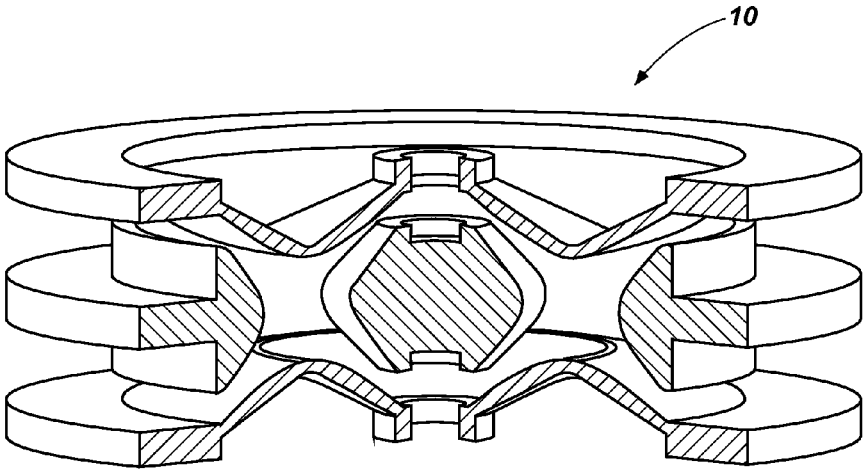
FIG. 1 (PRIOR ART)
FIG. 1 is a perspective and cut-away view of a toroidal ion trap as used in the prior art.
Figure 2:
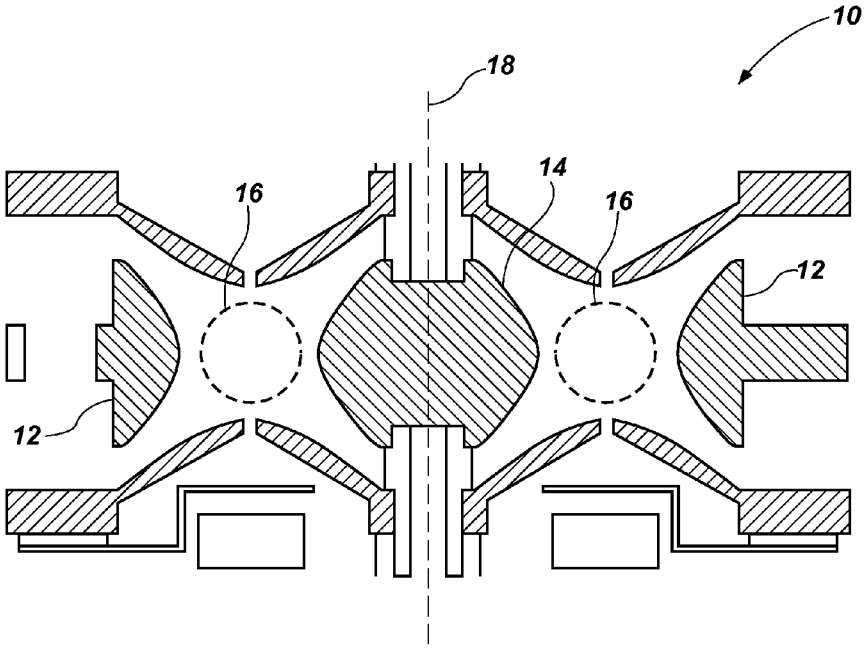
FIG. 2 (PRIOR ART)
FIG. 2 is cross-sectional view of the internal structure of the toroidal ion trap shown in FIG. 1.
Figure 3A:
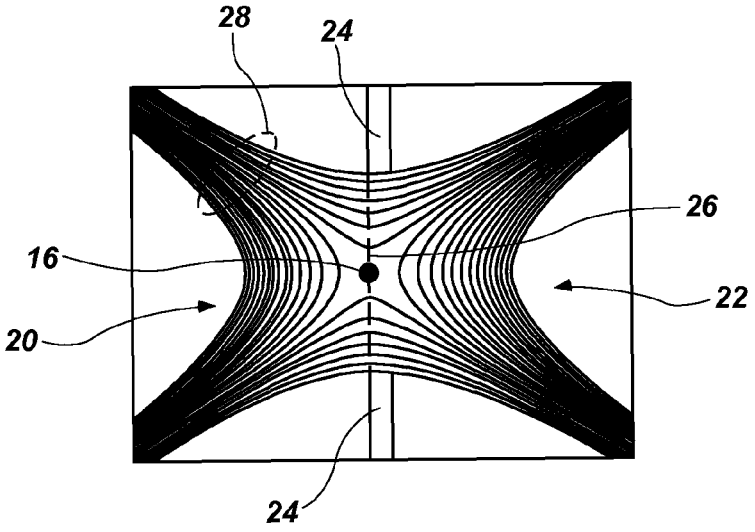
FIG. 3A (PRIOR ART)
FIG. 3A is a profile view of electric fields in a symmetric electrode design of an ion trap from the prior art.
Figure 3B:
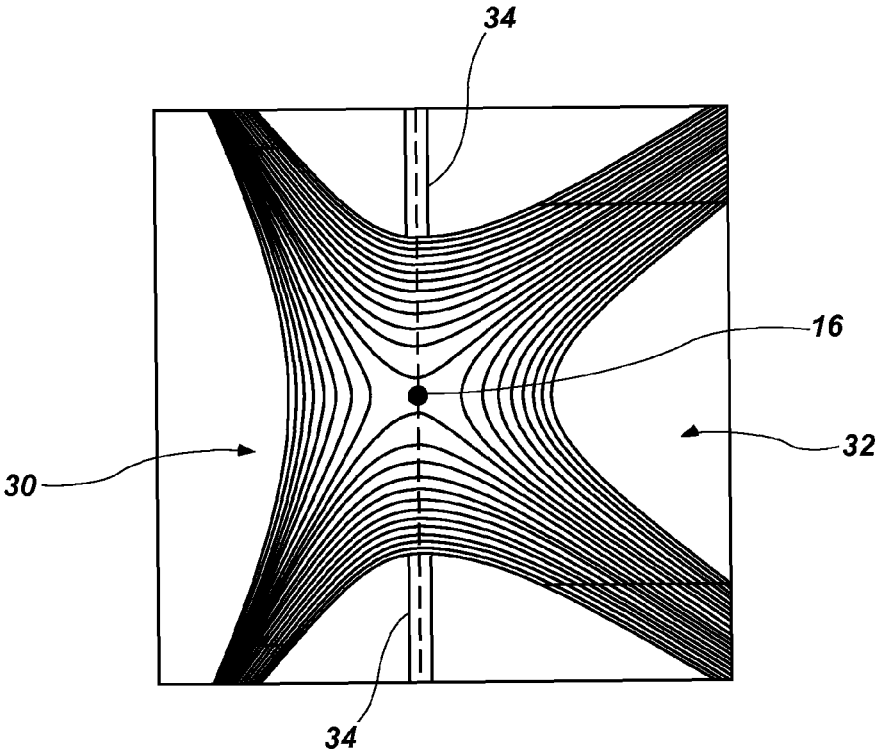
FIG. 3B (PRIOR ART)
FIG. 3B is a profile view of electric fields in an asymmetrical electrode design of an ion trap from the prior art.
Figure 4:
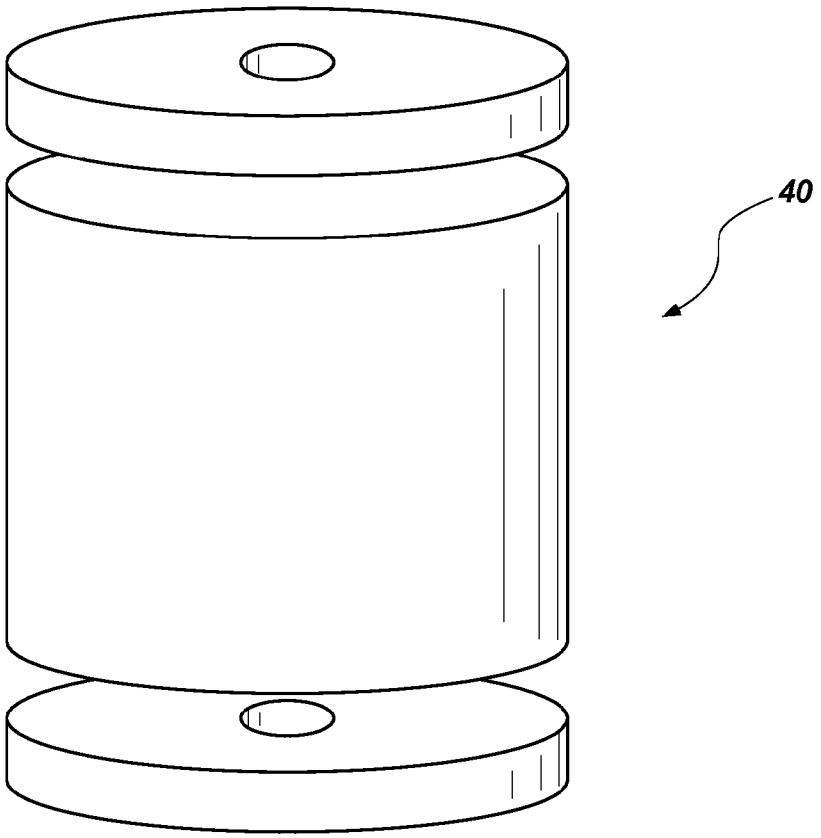
FIG. 4 (PRIOR ART)
FIG. 4 is a perspective view of a cylindrical ion trap from the prior art.

A mass analyzer ion trap that offers increased ion storage over other designs and is amenable to miniaturization is the toroidal RF ion trap mass analyzer, or hereinafter the toroidal ion trap. The toroidal ion trap can be viewed as either a conventional 3D ion trap cross section that has been rotated on an edge through space as shown in FIGS. 1 and 2, or as a linear quadrupole curved and connected end to end. In either case, distortions to the quadrupole trapping field introduced by the curvature of the storage region degrade the performance of the device and necessarily require corrections to the shape of the electrodes in order to generate the necessary ion trapping field. The modification to the electrodes is shown in FIG. 3B.

Because of its geometry, the toroidal ion trap may store ions in a relatively large volume by distributing them within a circular storage ring as will be shown.

The problem of designing a toroidal ion trap using cylindrical electrodes may be solved using a novel approach in which the electric fields are created using an asymmetric arrangement of cylindrical and planar electrodes.

Figure 5:
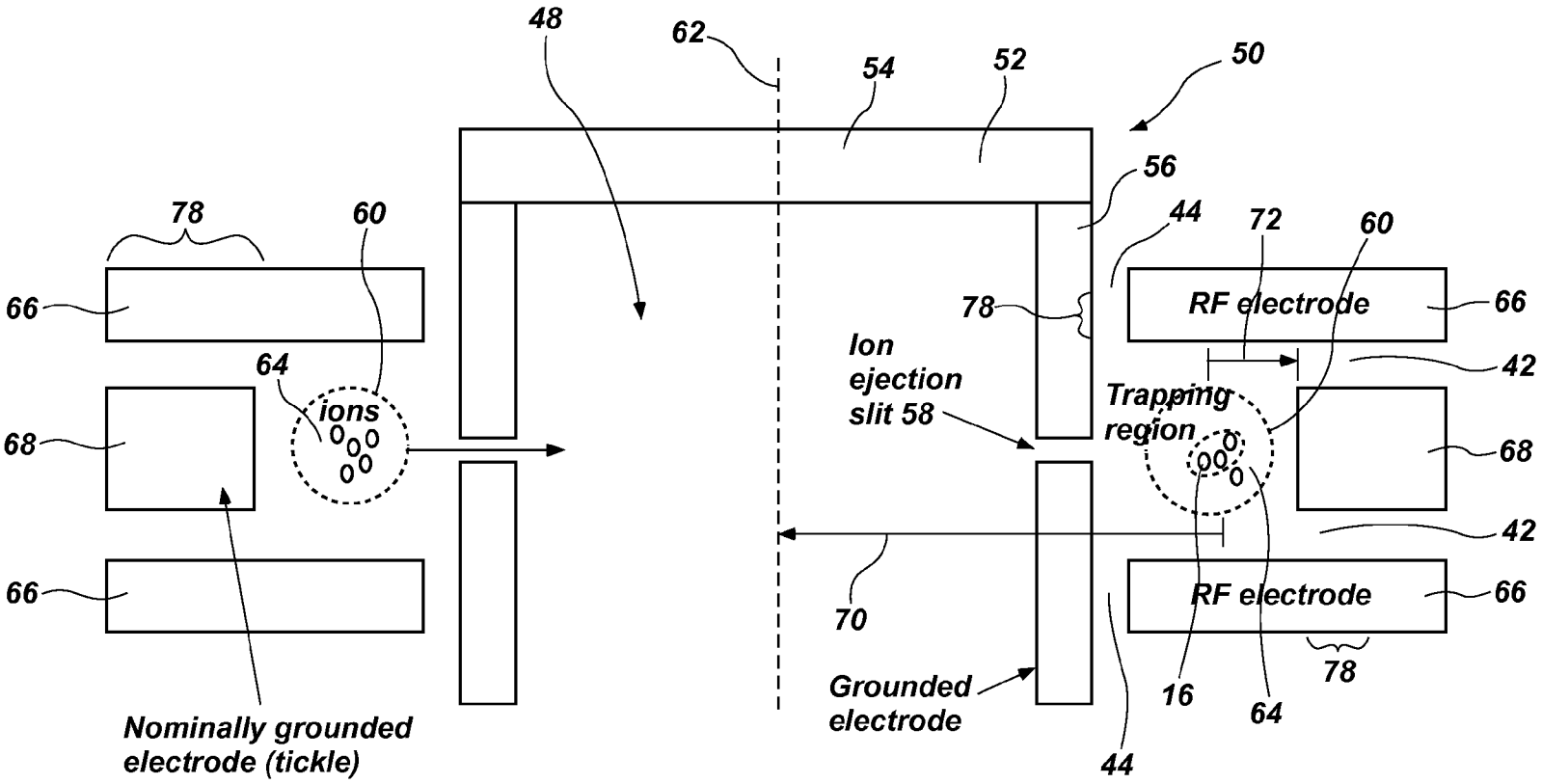
FIG. 5 is a cross-sectional profile view of a first embodiment of a cylindrical toroidal ion trap of the present invention using cylindrical and planar electrodes.
Figure 6:
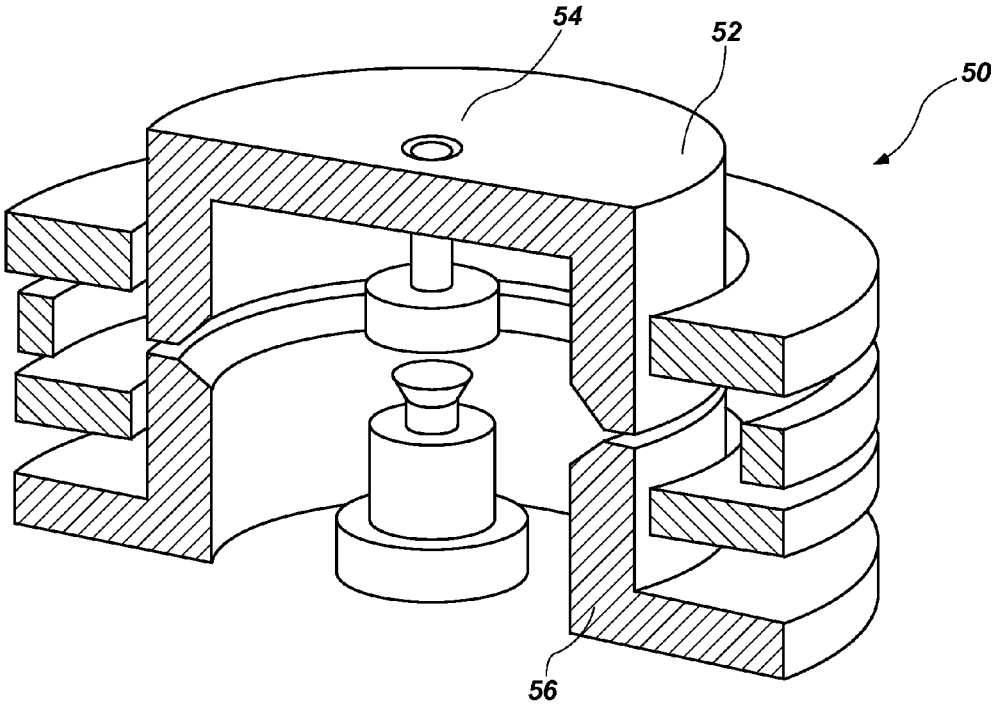
FIG. 6 is a perspective and cut-away view of the cylindrical toroidal ion trap from a first embodiment.
Figure 7:
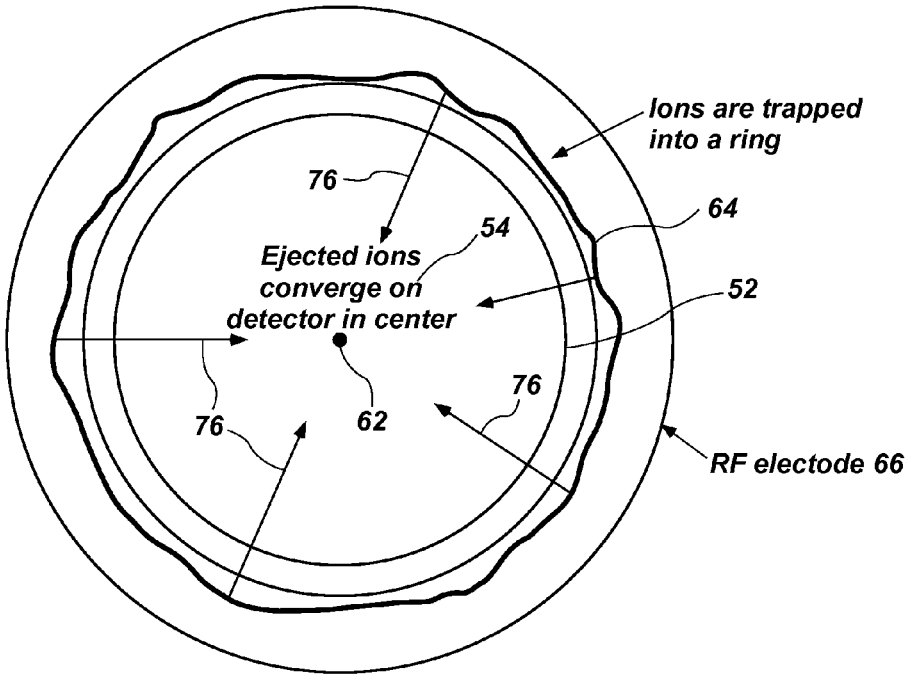
FIG. 7 is a top view of the embodiment of the cylindrical toroidal ion trap shown in FIG. 5.

FIG. 5 is a cross-sectional view of a first embodiment of a toroidal ion trap 50 having cylindrical electrodes (referred to hereinafter as a "cylindrical toroidal ion trap") of the present invention. FIG. 6 is provided as a perspective cut-away view of the cylindrical toroidal ion trap 50 of FIG. 5. FIG. 7 is provided as a top view of the cylindrical toroidal ion trap 50 shown in FIG. 5.

Instead of the hyperbolic electrodes of conventional toroidal ion traps, the electrodes may be formed from cylindrical and planar shapes. A central cylinder 52 may include a top cover 54 and curved wall 36. The curved wall 56 may include a plurality of ejection slits (to be referred to hereinafter as "ejection slit 58") through which ions may be ejected from a trapping region 16 within a trapping volume 60 which forms a ring around the central cylinder 52. The ejection slit 58 may be comprised of a ring around a circumference of the central cylinder 52. The ejection slit 58 may not be continuous around the central cylinder 52 but may be comprised of separate slit-like apertures through the wall 56 and which provide sufficient access for ions 64 to be ejected from the trapping volume 60 through the wall 56 and into an interior volume 48 of the central cylinder 52.

The central cylinder 52 includes a central axis 62. The ions 64 may travel toward the central axis 62 from all angles around the cylindrical toroidal ion trap 50. It may be said that the ions 64 may converge from the ring-like trapping volume 60 outside the central cylinder 52, pass through apertures 58 in the wall 56 of the central cylinder, and then travel to a detector at the central axis 62.

The trapping volume 60 may be characterized as a ring-like structure formed around the central cylinder 52 and may have a rectangular cross-section that is defined by four walls which may also be four electrodes. A portion of the outer surface of the central cylinder 52 may form an inner wall of the trapping volume 60. In other words, a portion of the wall 56 forms the inner wall of the trapping volume 60. Opposite and spaced apart from but parallel to the wall 56 is an outer electrode 68. Perpendicular to the inner electrode 56 and the outer electrode 68 of the trapping volume 60 are two walls opposite each other that are designated as RF electrodes 66. The RF electrodes 66 function as end-caps and are essentially ring-like disks that form a top and bottom of the trapping volume 60. The walls of the trapping volume are also electrodes of the trapping volume.

As shown, the four walls 56, 68, 66 and 66 of the trapping volume 60 are all spaced apart from each other. The gap between the four walls 56, 68, 66, 66 must be sufficient to prevent electrical arcing between them when a voltage is applied, but may be on the order to micrometers and millimeters. While each of the four walls of the trapping volume is shown as comprised of a single piece of material, any of the walls may also be separated into more than one piece of material as long as the plurality of wall pieces still provides the functionality described herein, and should not be considered to be outside the scope of the present invention.

The cylindrical toroidal ion trap 50 has a major toroidal radius 70 and a minor trapping radius 72. The spacing between the cylinder wall 56, the two RF electrodes 66 and the outer electrode 68, as well as the size of these electrodes 56, 66, 66 and 68, may be used to create the desired shape of electric fields created within the trapping volume 60. The concept of creating asymmetry in the electrodes that form the trapping volume 60 may best be explained by referring to FIGS. 15 and 16.

Figure 15:
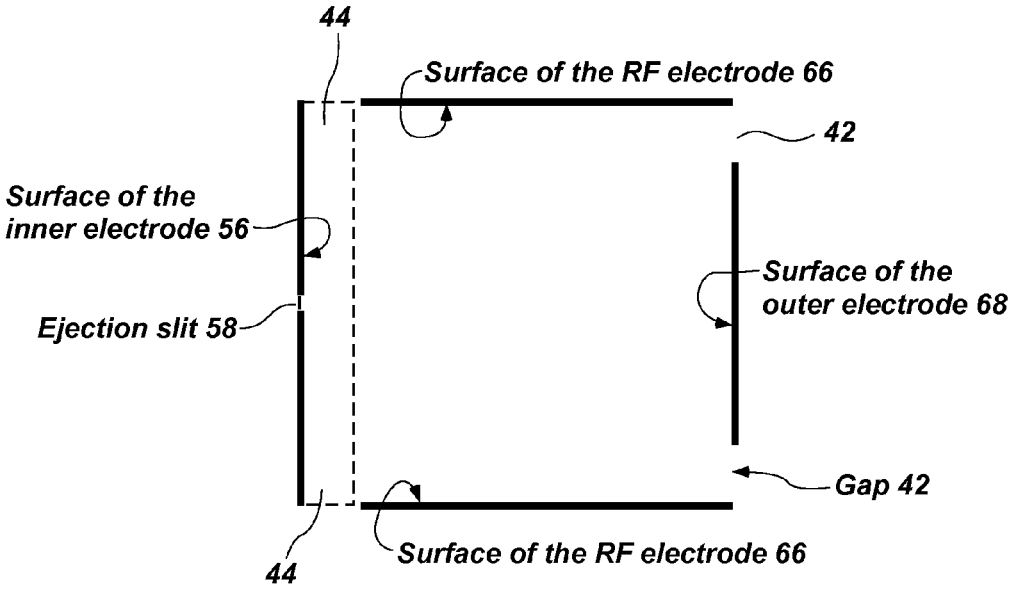
FIG. 15 is a profile view of the electrodes that can form a cross-section of the trapping volume, where the length of the electrodes creates the desired asymmetry in electrode design.

FIG. 15 is a profile view that illustrates the surfaces of the four electrodes 56, 68, 66 and 66 that presently define the trapping volume 60. The asymmetry is derived from the different surface area presented by the electrodes to the trapping volume 60. The surface of the inner electrode 56 is larger than the surface of the outer electrode 68 as seen by the ions in the trapping volume 60. This asymmetry in the surface area of the electrodes is the first aspect of the present invention that gives an improved shape to the electric fields within the trapping volume 60. It can also be stated that a length of the electrodes is different, which in turn affects the surface area.

Figure 16:
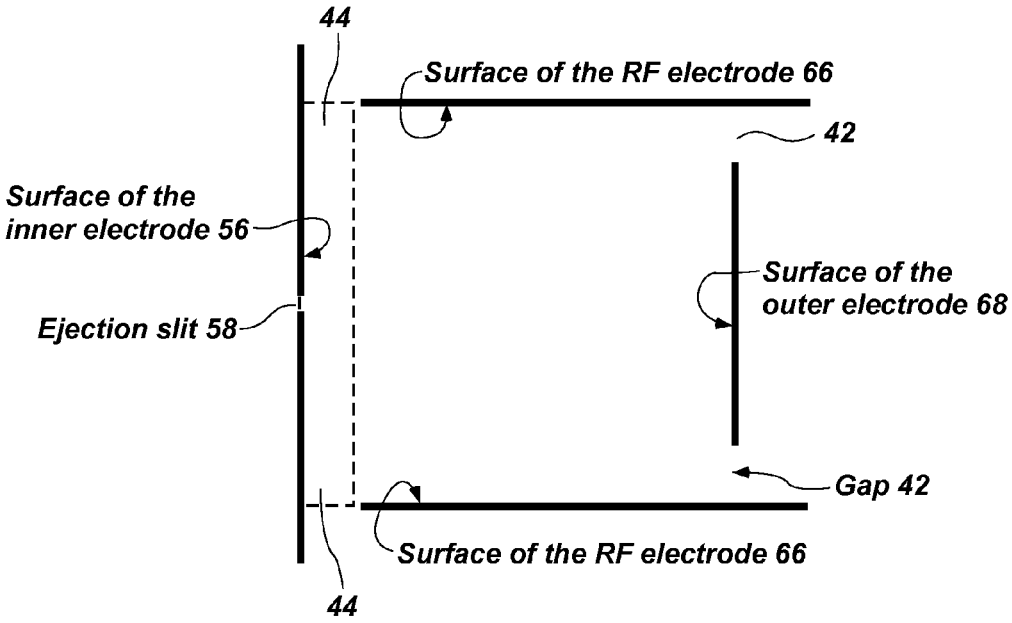
FIG. 16 is a profile view of the electrodes that can form a cross-section of the trapping volume, where the length of the electrodes is further modified to create overlapping that also creates the desired asymmetry in electrode design.

FIG. 16 demonstrates another aspect of asymmetry in the trapping volume. Some of the electrodes extend beyond the ends of immediately adjacent electrodes shown in FIG. 15. For example, the inner electrode 56 is part of the wall of the central cylinder 52. Thus, the inner electrode 56 can be characterized as extending in the vertical directions shown beyond the two RF electrodes 66. Likewise, the length of the two RF electrodes 66 is extended outwards away from the central cylinder 52 beyond the edges of the outer electrode 68. This extension of the length of the inner electrode 56 and of the two RF electrodes 66 further changes the shape of the electric fields within the trapping volume 60.

Another way to state what is occurring is that in FIG. 15 is that the present invention identifies at least four different aspects of the invention that enable compensating for toroidal curvature by changing the shape of electric fields within the trapping volume. One method is having different sizes for the inner electrode 56 and the outer electrode. Another method is the extension of the lengths of the inner electrode 56 and the two RF electrodes 66. Another method is the orientation of the gaps 42, 44, where the gaps 42 are vertical and the gaps 44 are horizontal. Another method is using the width of the gaps 42, 44 between the electrodes 56, 66, 66 and 68.

Regarding overlapping of electrodes as shown in FIG. 5, it is noted that empirical evidence suggests that the effect of the overlap does not increase after approximately a millimeter in length of overlap 78. Another area of electrode overlap is the inner wall electrode 56 extending beyond the two RF electrodes 66.

It is noted that the first embodiment uses a major toroidal radius 70, or R, that is approximately 3 cm, but a useful range of radii for the major toroidal radius may vary between 3 cm and 20 micrometers, or extend beyond these lengths. Similarly, the first embodiment uses a minor trapping radius 72 that is approximately 6 mm, but a useful range of radii for the minor trapping radius may vary between 20 mm and 1 micrometer, or extend beyond these lengths. However, even these ranges should not be considered to be limiting, but only function as a guide to the dimensions that may be obtainable for the cylindrical toroidal ion trap 50 of the present invention.

Figure 8:
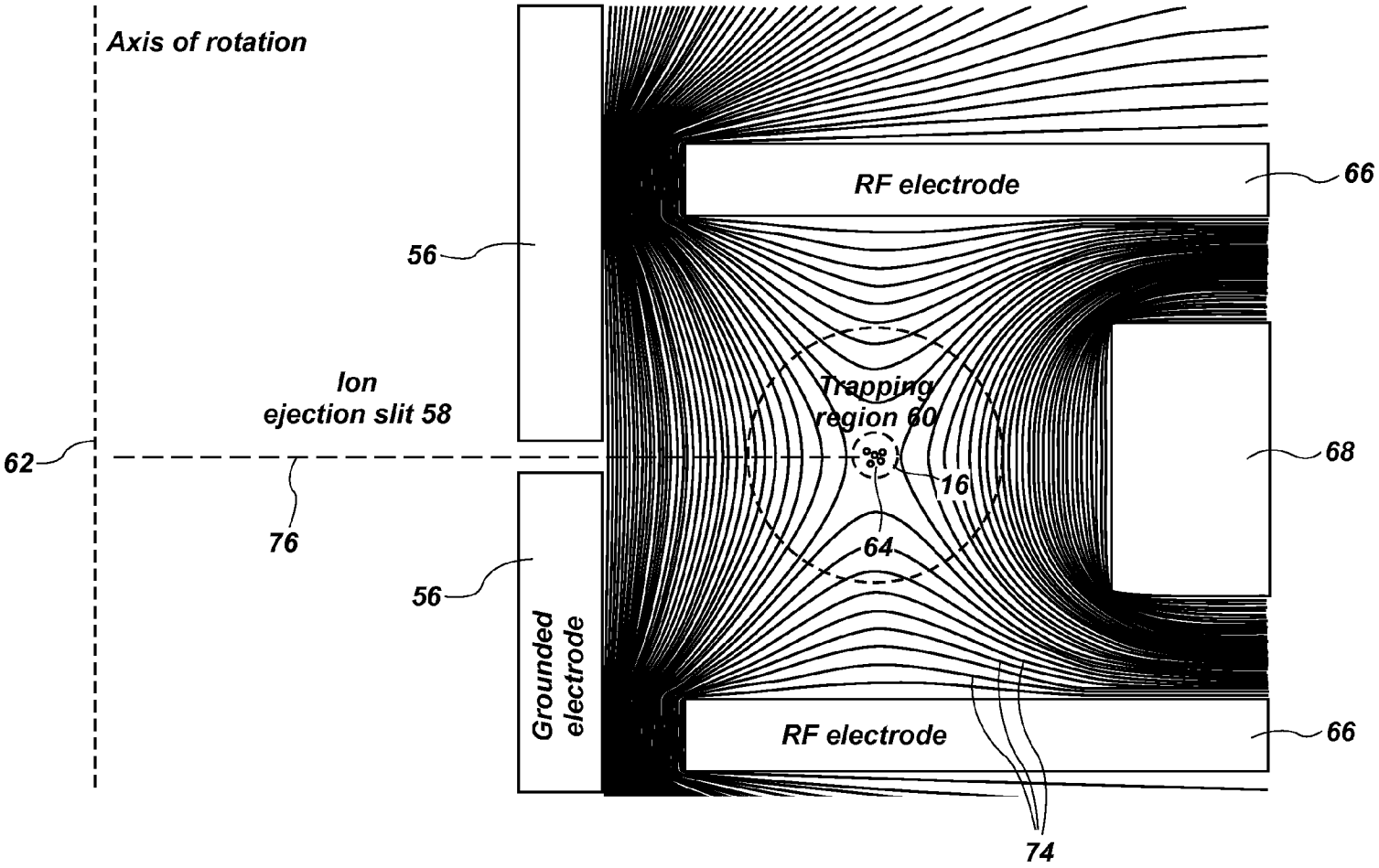
FIG. 8 is a close-up cross-sectional view of the trapping volume of the cylindrical toroidal ion trap shown in FIG. 5.

FIG. 8 is a close-up cross-sectional view of the trapping volume 60, including the wall 56 of the central cylinder 52, the two RF electrodes 66, and the outer electrode 68. The electric field lines 74 may be substantially perpendicular to ion motion when the ions 64 are ejected from the trapping volume 60 through the ejection slit 58 as shown by dotted path 76.

In this first embodiment, the wall 56 may be grounded, the RF electrodes 66 may have an RF signal applied, and the outer electrode 68 may be grounded. It is believed that the narrower outer electrode 68 compensates for the larger area a given ion 64 "sees" of the outer electrode. Likewise, the cylinder wall 56 performs a similar function of compensating for the smaller area that is seen by the ions 64.

The first embodiment lends itself to cylindrical toroidal ion trap 50 designs that may have a major toroidal radius 70 that is much larger than the minor trapping radius 72. However, it is an aspect of the present invention that the ratio of the major toroidal radius 70 to the minor trapping radius 72 may vary greatly, depending on such factors that include but are not limited to the size of the electrodes 56, 66, 66, 68, the arrangement of the electrodes, and the width between them.

The central cylinder 52 has been described as being at electrical ground. Alternatively, an RF or AC potential may be applied for different modes of operation of the cylindrical toroidal ion trap 50. Likewise, the narrow outer electrode 68 may generally be electrically grounded, but an RF or AC potential may be applied for the purposes of ion ejection, excitation, or other purposes related to operation of an on trap mass analyzer.

The two RF electrodes 66 may function as end-caps for the trapping volume 60. The frequency and amplitude of the RF signal that is applied may correspond to typical ion trap parameters.

Ejection of ions 64 from the trapping volume 60 occurs as the ions are excited by an AC potential or by the trapping boundary. The ions 64 follow converging paths 76 as shown in FIGS. 7 and 8. The central cylinder 52 may also function as shielding for at least one ion detector disposed along the central axis 62.

Because all ions 64 ejected from the trapping volume 60 converge on a single point 62, a Faraday-type detector (a metal wire connected to a charge or current-sensitive amplifier) can be used instead of an electron multiplier for detection of ions.

It was stated previously that the frequency and amplitude of the RF signal that is applied may correspond to typical ion trap parameters. Regarding ion trap parameters, the frequency and voltage used in a toroidal RF ion trap is determined by the characteristic trapping dimensions, usually $r_0$, $x_0$, $y_0$, or $z_0$, representing the distance from the center of the trapping volume 60 to the nearest electrode surfaces.

In an ion trap with toroidal geometry the characteristic trapping dimension is $r_0$ or the minor trapping radius 72. In a toroidal trap there is an additional dimensional variable, R or the major toroidal radius 70, representing the distance from the center of the trapping volume 60 to the central axis 62 of rotational symmetry, or the center of the device 50. These two dimensional variables are independent, thus R and $r_0$ may both be varied independent of the other. However, as the ratio of these two variables changes, there is a corresponding change in the amount of asymmetry required to correct for curvature in the electric fields within the trapping volume 60. This may lead to a change in the amount of overlap 78 of the RF electrodes 66 and the outer electrode 68 required in the design.

One way to miniaturize the cylindrical toroidal ion trap 50 of the present invention is to reduce the minor trapping radius 72, while keeping the major toroidal radius 70 large, effectively making a high aspect-ratio trap. In this way, the benefits of a miniaturized ion trap, namely higher operating pressure and lower electrical voltages and power, can be realized while maintaining a large trapping volume and large number of trapped ions.

This ratio of radii 70, 72 is analogous to extending the length of a linear ion trap or a rectilinear ion trap, but with the added advantage that ions still converge to a point in the cylindrical toroidal ion trap 50, no matter the size of the radii. Furthermore, for such a large aspect-ratio design, any misalignment between the central cylinder 52 and the trapping volume 60 will not be any worse, for a given linear translation, than in a small-aspect-ratio ion trap with the same minor trapping radius 72. If the major toroidal radius 70 is sufficiently large, a multiple-element detector will still fit within the central cylinder 52, and could be used to compensate for any misalignment between electrodes.

Figure 9:
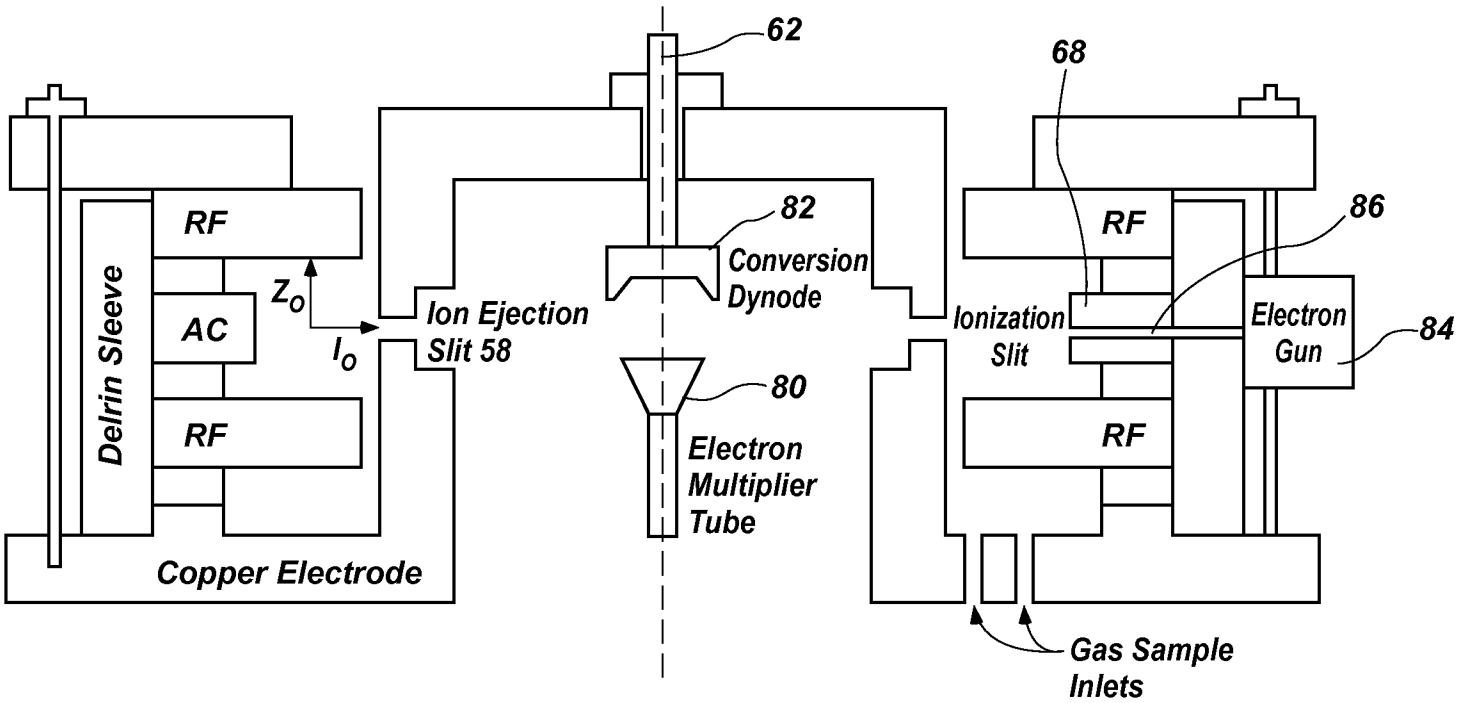
FIG. 9 is a more detailed cross-sectional profile view of the cylindrical toroidal ion trap shown in FIG. 5.

FIG. 9 shows a possible detection scheme for the first embodiment. Specifically, an electron multiplier tube 80 is disposed at the center of the central cylinder 52. Ions 64 passing through the ejection slit 58 travel to the central axis 62 where they curve toward a conversion dynode 82 and are then detected by an electron multiplier tube 80.

It is noted that a voltage difference may be applied between a detection wire at the central axis 62 and the housing or central cylinder 52 which may enhance ion detection. The use of a Faraday-type detector may also facilitate higher operating pressures that are not now possible in ion traps.

The lathing operations that are needed to machine the cylindrical toroidal ion trap 50 of the present invention are among the most accurate that can be done using conventional machining techniques. Accordingly, maintaining electrode shape and alignment accuracy is easier than it is for other types of ions traps using curved or hyperbolic surfaces.

In addition, the cylindrical toroidal ion trap 50 of the present invention may be manufactured using microfabrication techniques because of the cylindrical and planar shapes of electrodes, and the perpendicular arrangement of the electrodes.

As stated earlier, the ratio of radii 70 and 72 can vary greatly. A large major toroidal radius 70 reduces curvature of the wall 56, which may make it easier to create the desired shape in the electric fields of the trapping volume 60.

Another advantage of the first embodiment is that the major toroidal radius 70 does not need to be reduced in order to expect higher operating pressure. The operating pressure may scale as the mean free path of ions 64 in the ion trap as compared with the characteristic dimensions of the trapping volume 60. Furthermore, the use of Faraday-type detectors is not limited to high vacuum situations. Accordingly, the present invention lends itself to a large central cylinder 52, but with very small trapping volume 60 dimensions. The result is a high aspect-ratio ion trap providing excellent sensitivity.

It should be remembered that the dimensions of the toroidal ion trap mass analyzer as described above are for illustration purposes only. The present invention should not be considered to be limited by the specific dimensions or other operational parameters given, but should be regarded as examples only. Many dimensions and operational parameters may be modified and the mass analyzer will still operate as desired, in accordance with the principles of the present invention.

Utilizing cylindrical electrodes enables the present invention to also be miniaturized. One of the factors that makes miniaturization possible is that the electrodes 56, 66, 66 and 68 have geometries that are simple to manufacture as opposed to the hyperbolic electrodes of the prior art.

Another aspect of the present invention is directed to the methods in which ions may be introduced into the circular trapping volume 60. The ions may be introduced from an outside source, they may be created within the trapping volume 60 or a combination of the two. FIG. 9 shows an electron gun 84 that may introduce ions 64 into the trapping volume 60 through an injection port 86 passing through the outside electrode 68. The electron gun 84 may be positioned at any appropriate location that provides access to the trapping volume 60.

Scaling the present invention in order to obtain a miniaturized cylindrical toroidal ion trap is not a straight-forward task, and the generation or introduction of ions is an important aspect of the present invention. It is desirable to have a system capable of trapping and detecting ions that are created externally as well as internally.

In second and third embodiments of the present invention, an Omega-trap and a Rho-trap were conceived for introducing ions into the trapping volume 60. The names of the traps are derived from the shape of the electrodes.

Figure 10:
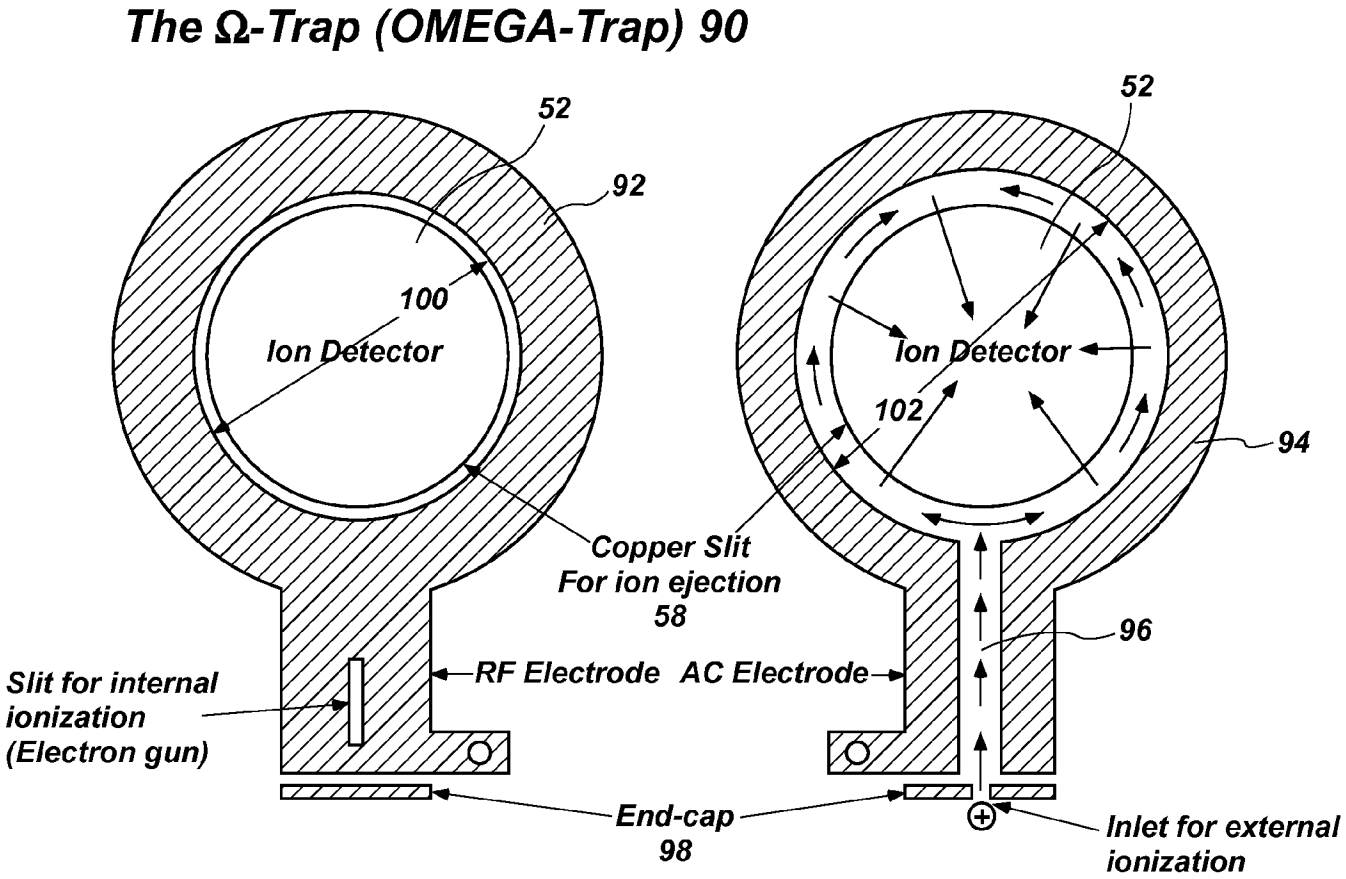
FIG. 10 is a top view of an RF electrode and an AC electrode from a second embodiment of a cylindrical toroidal ion trap referred to as an Omega-trap that is manufactured from sheet metal.
Figure 12:
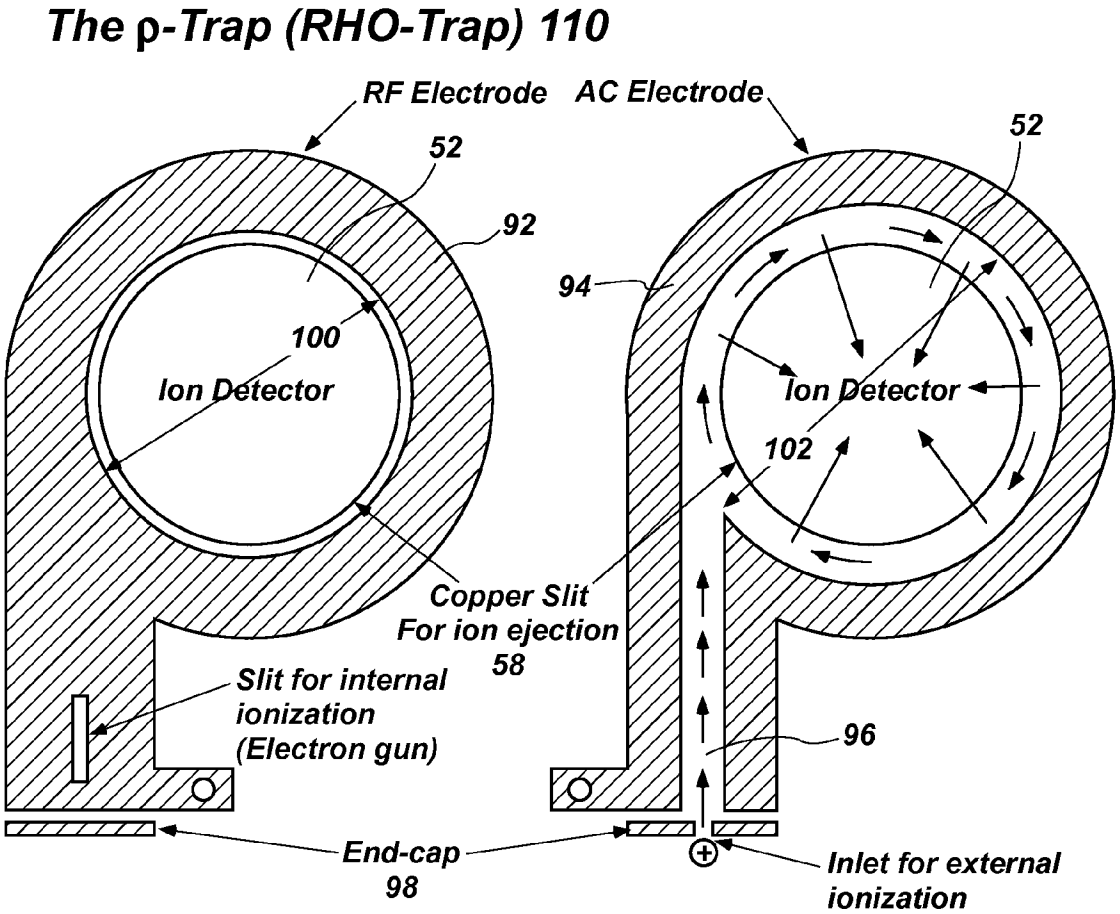
FIG. 12 is a top view of an RF electrode and an AC electrode from a third embodiment of a cylindrical toroidal ion trap referred to as a Rho-trap that is manufactured from sheet metal.

The Omega-trap 90 is shown in FIG. 10 and the Rho-trap 110 is shown in FIG. 12 from a top viewpoint. The Omega-trap 90 and the Rho-trap 110 are formed of at least two RF electrodes 92 with an AC electrode 94 disposed inbetween. Both traps may be increased in size by adding additional layers, with an RF electrode 92 always being on the top and bottom of a stack.

FIGS. 10 and 12 shows that there is a multi-layer cylindrical toroid structure that is formed by a circular ring that forms the RF electrode 92 that is disposed on the top and bottom of the ion traps. The RF electrodes 92 overlap and extend further inwards toward a central axis than a middle AC electrode 94 disposed between the two RF electrodes 92. The RF electrodes 92 are coaxial with the AC electrode 94. An inner diameter 100 of the two RF electrodes 92 is smaller than an inner diameter 102 of the AC electrode 94. It should also be recognized that the two RF electrodes 92 overlap the entire ring-structure of the AC electrode 94. The trapping volume 60 shown in FIG. 14 is where the two RF electrodes 92 overlap the thicker AC electrode 94 that has a larger inner diameter.

The difference between the Omega-trap 90 and the Rho-trap 110 may be in the placement of a linear ion guide 96. In the Omega-trap 90, the linear ion guide 96 is disposed perpendicular to the path of the trapping volume 60 around the central cylinder 52. In contrast, the linear ion guide 96 is disposed so as to be tangential to the path of the trapping volume 60 around the central cylinder 52. The Rho-trap 110 design may provide advantages over the Omega-trap 90 design simply because of the placement of the linear ion guide 96. It may be easier to introduce ions into a trapping volume 60 using the tangentially placed linear ion guide 96.

It is noted that placement of the linear ion guide 96 may also vary between the strictly tangential alignment and the strictly perpendicular alignment. Thus, the linear ion guide 96 can enter the trapping volume from any angle between zero and 90 degrees.

Figure 14:
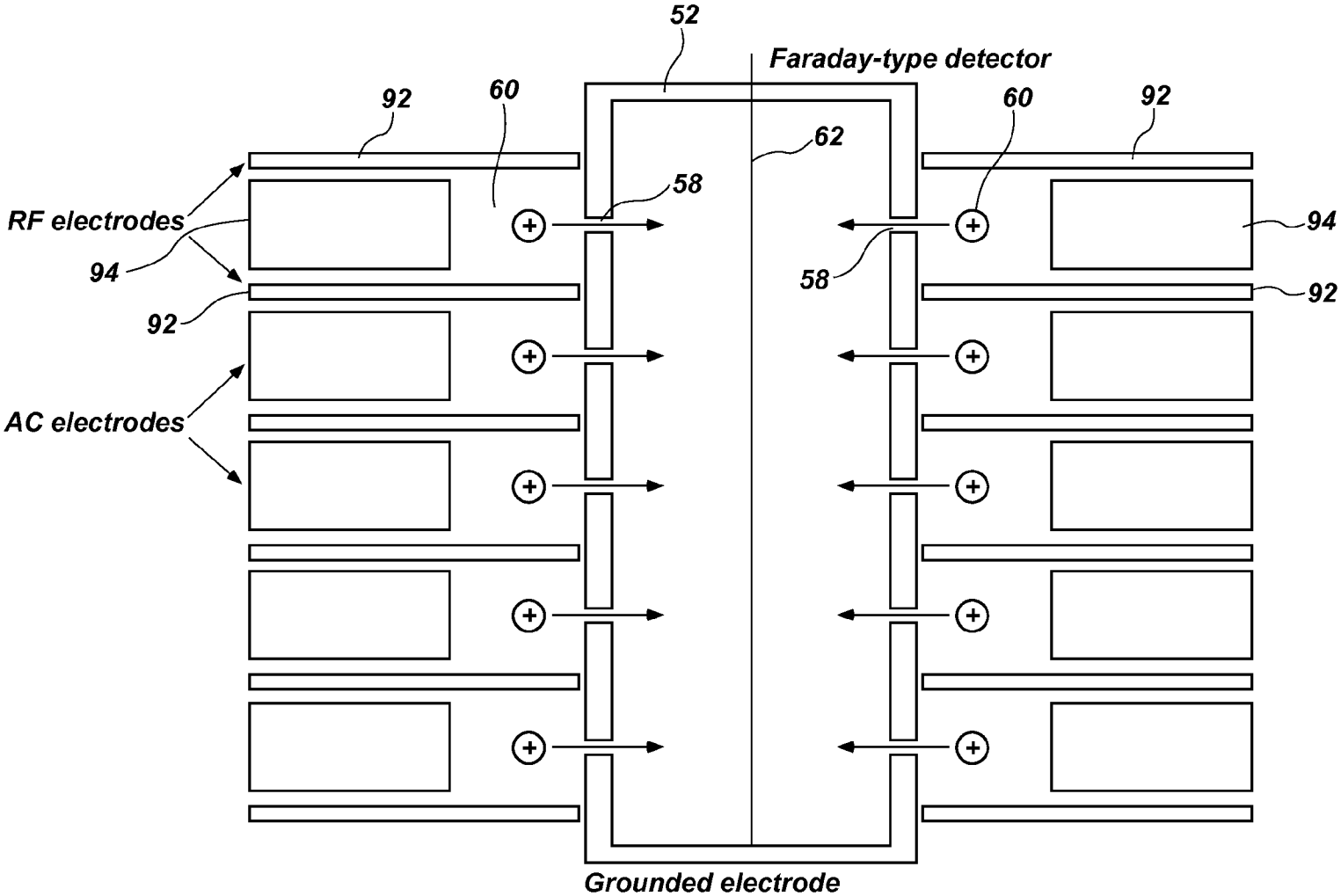
FIG. 14 is a stacked or layered fourth embodiment of a cylindrical toroidal ion trap.

FIG. 14 is a profile view of what can be either the first embodiment shown in FIG. 5, the Omega-trap 90 or the Rho-trap 110, and demonstrates the ability to create a stacked array of electrodes that form the ion traps. Thus, FIG. 14 demonstrates that the smallest configuration may be comprised of an RF electrode 92 on top and an RF electrode 92 on the bottom, and an AC electrode 94 disposed in between the two RF electrodes 92. By adding more AC electrodes 94 and RF electrodes 92, a stacked array is created. A central cylinder 52 is disposed in the center of the electrodes 92, 94.

Figure 11:
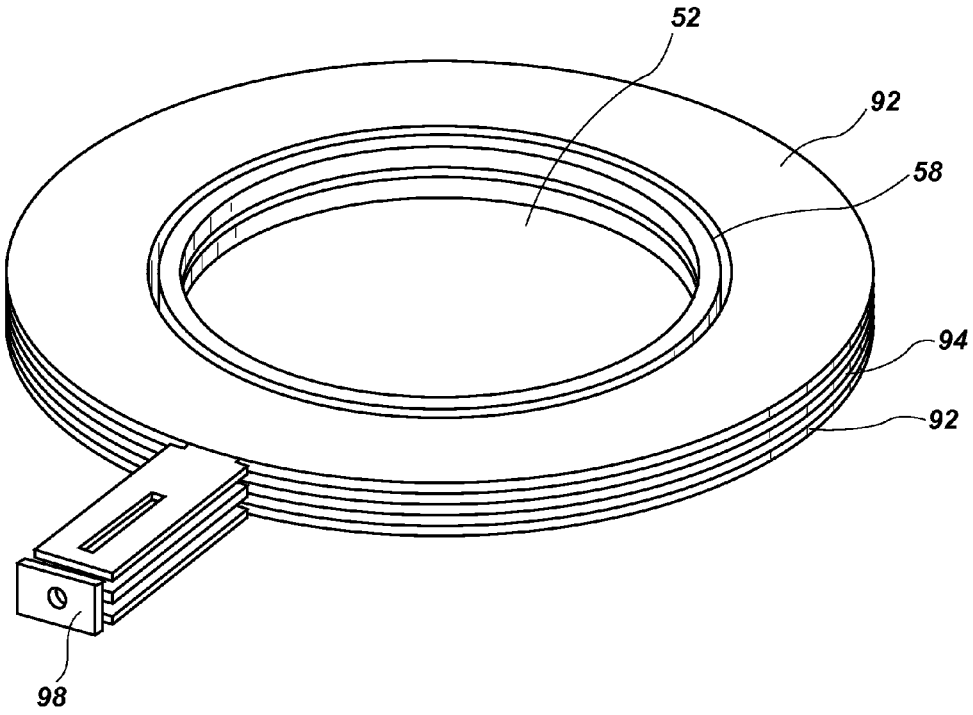
FIG. 11 is a perspective view of the second embodiment shown in FIG. 10.
Figure 13:
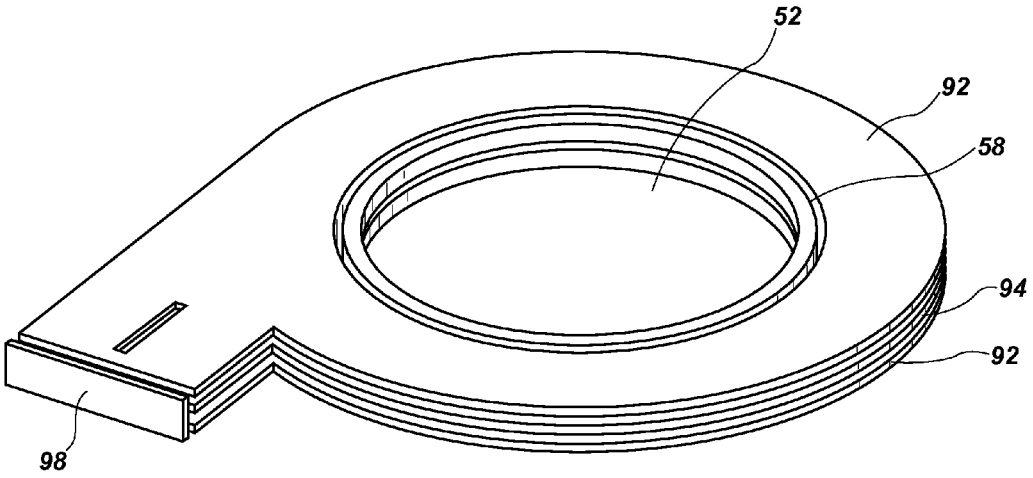
FIG. 13 is a perspective view of the second embodiment shown in FIG. 12.

FIG. 11 is a perspective view of the Omega-trap 90. FIG. 13 is a perspective view of the Rho-trap 110.

The Omega-trap 90 and the Rho-trap 110 are miniature versions of the cylindrical toroidal ion trap 50 but with the addition of a means for introducing ions into the traps, with the names being derived from the shape of the ion traps. The RF electrodes 92 of the Omega-trap 90 and Rho-trap 110 may be constructed of sheet metal or another thin metal of uniform thickness. Sheet metal may be used because of the high thickness tolerances that can be maintained. Using sheet metal, very small trapping dimensions can be achieved while maintaining a relatively large trapping volume 60 (see FIG. 14) with a minimal or no loss in performance. Depending on the trapping volume dimensions, the AC electrode 94 may be made from sheet metal or it may be machined from thicker metal using conventional machining techniques.

Both the Omega-trap 90 and the Rho-trap 110 are shaped so as to provide the linear ion guide 96, enabling ions that are generated externally or internally to be collected and guided into the trapping volume 60. The ions may be collected externally using a method such as electrospray, thermal desorption/ionization, laser ablation/ionization, etc., or internally using a method such as electron impact, glow/corona discharge, chemical ionization, etc.

The addition of an end-cap 98 on both the Omega-trap 90 and the Rho-trap 110 enables ions to be confined in the trapping volume 60 without escaping. The end-cap 98 may also be gated to enable externally generated ions to accumulate in the trapping volume 60 until a mass scan is performed. Gating may be most beneficial when performing a tandem mass analysis, aiding in the reduction of chemical noise.

As shown in FIG. 14, the use of cylindrical electrodes manufactured from sheet metal enables the Omega-trap 90 and the Rho-trap 110 designs to be layered or stacked, effectively creating multiple coincident toroidal trapping volumes. While the toroidal trapping volume already has an advantageously large trapping volume, some of that volume is lost when the minor trapping radius is reduced in a miniature cylindrical toroidal ion trap created from the Omega-trap 90 or the Rho-trap 110 designs. By stacking the ion traps as shown in FIG. 14, the loss of trapping volume 60 may be compensated for and may enhance the trapping volume by several factors.

As also shown in FIG. 14, ion ejection will occur radially for each toroidal trapping layer, creating several axial points in which the ejected ions would occur along the length of the central axis 62. Again, the use of a Faraday-type wire detector may be ideal for this cylindrical toroidal ion trap.

Other arrangements of arrayed cylindrical toroidal ion traps are also possible and may provide some advantages. For instance, with either stacked traps or concentric traps, it may be possible to transfer ions between traps, allowing tandem-in space experiments. In such experiments, ions can be isolated by mass in one trap, fragmented in the next trap, and the fragment ions transferred into yet another trap for mass analysis. The order in which specific procedures are performed on the ions may also be changed as desired. Another possible advantage of an array of traps is that sensitivity would be enhanced with multiple traps acting in parallel.

It should be apparent that the Omega-trap 90 and the Rho-trap 110 could not be constructed using the hyperbolic surfaces of conventional toroidal ion traps. Furthermore, it is a simple matter to change the size of the toroidal trapping volume 60 by simply changing the length, thickness or spacing of the RF electrodes 92 and the AC electrodes 94 and thereby obtain the desired asymmetric arrangement of cylindrical and planar electrodes that will generate the desired electric fields that will elect ions in the desired path.

The embodiments of the present invention are directed toward a trapping volume formed as a ring with a rectangular cross-section, the trapping volume formed from two electrodes having complementary arcuate surfaces 56, 68 forming opposite sides of the trapping volume, and two other electrodes having planar surfaces forming flattened and ring-like disks 66, 66 that form the other two sides of the trapping volume 60. The two planar electrodes 66, 66 and two complementary arcuate electrodes 56, 68 may have substantially smooth and regular surfaces without artifacts. These surfaces are designed as such not only to simplify the manufacturing process, but to enable the trapping volume to be miniaturized using state of the art manufacturing techniques.

Nevertheless, slight deviations from perfectly planar and arcuate surfaces should not be considered as departing from the inventive concepts, and are within the scope of the claims of the present invention. The slight deviations may include such things as slanted surfaces, but they should still be surfaces that lend themselves to straight-forward manufacturing techniques. What is important is that the non-complex surfaces of the trapping volume 60 enable the electric fields to be shaped using an asymmetric arrangement of electrodes to obtain the desired ejection of ions.

It is also noted that one or more of the arcuate electrodes 56, 68 or the two RF electrodes 66 may be given a hyperbolic surface, and still take advantage of the principles of the present invention, and should be considered to be within the scope of the present invention.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A system for trapping ions in a toroidal ion trap having cylindrical electrodes, said system comprised of:

a central cylinder having an outer wall that functions as an electrode; and a trapping volume comprised of at least four electrode walls that have asymmetry in length that compensates for toroidal curvature and creates a desired shape in electric fields within the trapping volume by using electrodes that have arcuate and planar surfaces, the at least four electrode walls forming a ring around an outer wall of the central cylinder and having a rectangular cross-section.

2. The system as defined in claim 1 wherein the system is further comprised of:

an outside surface of a wall of the central cylinder forming a first electrode wall of the trapping volume;

an outer electrode forming a second and opposite electrode wall that is disposed parallel to and spaced apart from the first electrode to form complementary arcuate surfaces, wherein the outer electrode wall has a length that is less than the first electrode wall to create the asymmetry in length of the electrodes; and two planar disks forming a third electrode wall and an opposite fourth electrode wall that are perpendicular to the first and second electrode walls of the trapping volume.

3. The system as defined in claim 2 wherein the system is further comprised of a plurality of ejection slits disposed as a ring around a circumference of the central cylinder and through the outer wall, wherein the trapping volume is centered on the plurality of ejection slits on the first electrode wall.

4. The system as defined in claim 3 wherein the system is further comprised of at least one ion detector disposed at a central axis of the central cylinder, the at least one ion detector detecting ions ejected into the central cylinder through the plurality of election slits.

5. The system as defined in claim 4 wherein the system is further comprised of means for applying RF and AC signals to the at least four electrode walls of the trapping volume, to thereby separate ions according to mass-to-charge ratios of charged particles and charged particles derived from atoms, molecules, particles, sub-atomic particles and ions.

6. The system as defined in claim 5 wherein the system is further comprised of an ion source for creating and introducing ions into the trapping volume through the outer electrode wall.

7. The system as defined in claim 6 wherein the system is further comprised of using overlapping of a portion of the at least four electrode walls to thereby create further asymmetry and compensate for toroidal curvature.

8. The system as defined in claim 7 wherein the system is further comprised of extending a length of the third electrode wall and the fourth electrode wall past the outer electrode wall to further create the asymmetry in the at least four electrode walls.

9. The system as defined in claim 8 wherein the system is further comprised of the electric fields within the trapping volume being formed such that a portion of the electric fields are substantially perpendicular to a path from a trapping region within the trapping volume, the path leading through at least one of the plurality of ejection slits through the central cylinder.

10. The system as defined in claim 9 wherein the system is further comprised of the AC signal being applied to the first electrode wall and the outer electrode wall to thereby enable ejection of ions from the trapping volume and towards the ion detector.

11. The system as defined in claim 10 wherein the system is further comprised of an electron multiplier tube disposed at the central axis of the central cylinder.

12. The system as defined in claim 11 wherein the system is further comprised of a conversion dynode at the central axis of the central cylinder.

13. The system as defined in claim 1 wherein the system is further comprised of:

a major toroidal radius that is between 3 cm and 20 micrometers; and a minor trapping radius that is between 20 mm and 1 micrometer.

14. The system as defined in claim 1 wherein the system is further comprised of using characteristics of gaps between the at least four electrode walls to thereby compensate for toroidal curvature, said characteristics including the width of the gaps and orientation of the gaps.

15. A method for trapping ions in a toroidal ion trap having cylindrical electrodes, said method comprised of:

1) providing a central cylinder having an outer wall that functions as an electrode;

2) providing a trapping volume comprised of at least four electrode walls that form a ring around the central cylinder and having a rectangular cross-section;

3) creating asymmetry in length of the at least for electrode walls that compensates for toroidal curvature and creates a desired shape in electric fields within the trapping volume by using electrodes that have arcuate and planar surfaces, the at least four electrode walls forming a ring around an outer wall of the central cylinder and having a rectangular cross-section; and 4) trapping ions within the electric fields within the trapping volume.

16. The method as defined in claim 15 wherein the method further comprises:

1) providing an outside surface of a wall of the central cylinder as a first electrode wall of the trapping volume;

2) providing an outer electrode forming a second and opposite electrode wall that is disposed parallel to and spaced apart from the first electrode to form complementary arcuate surfaces, wherein the outer electrode wall has a length that is less than the first electrode wall to create the asymmetry in length of the electrodes; and 3) providing two planar disks forming a third electrode wall and an opposite fourth electrode wall that are perpendicular to the first and second electrode walls of the trapping volume.

17. The method as defined in claim 16 wherein the method further comprises:

1) providing at least one ion detector disposed at a central axis of the central cylinder; and 2) detecting ions ejected into the central cylinder through the plurality of ejection slits.

18. The method as defined in claim 17 wherein the method further comprises:

1) applying RF and AC signals to the at least four electrode walls of the trapping volume; and 2) separating ions according to mass-to-charge ratios of charged particles and charged particles derived from atoms, molecules, particles, sub-atomic particles and ions.

19. The method as defined in claim 18 wherein the method further comprises providing an ion source for creating and introducing ions into the trapping volume through the outer electrode.

20. The method as defined in claim 19 wherein the method further comprises overlapping at least a portion of the of the last least our electrodes walls to thereby create further asymmetry and compensate for toroidal curvature.

21. The method as defined in claim 20 wherein the method further comprises extending a length of the third electrode wall and the fourth electrode wall past the outer electrode wall to further create the asymmetry in the at least four electrode walls.

22. The method as defined in claim 21 wherein the method further comprises forming the electric fields within the trapping volume such that a portion of the electric fields are substantially perpendicular to a path from a trapping region within the trapping volume, the path leading through at least one of the plurality of ejection slits through the central cylinder.

23. The method as defined in claim 22 wherein the method further comprises applying the AC signal to the inner electrode wall and the outer electrode wall to thereby enable ejection of ions from the trapping volume and towards the ion detector.

24. The method as defined in claim 23 wherein the method further comprises providing an electron multiplier tube at the central axis of the central cylinder.

25. The method as defined in claim 24 wherein the method further comprises providing a conversion dynode at the central axis of the central cylinder.

26. The method as defined in claim 25 wherein the method further comprises reducing the power requirements of the cylindrical toroidal ion trap because of the reduced size thereof.

27. The method as defined in claim 15 wherein the method further comprises:

1) applying the RF signal to the third electrode wall and the fourth electrode wall of the trapping volume; and
2) electrically grounding the first electrode wall and the second electrode wall of the trapping volume.

28. A method for separating ions according to mass-to-charge ratios of charged particles and charged particles derived from atoms, molecules, particles, sub-atomic particles and ions, using a toroidal ion trap mass analyzer having cylindrical electrodes, said method comprising:

1) providing a central cylinder having an outer wall that functions as an electrode; and
2) providing a trapping volume comprised of at least four electrode walls that form a ring around the central cylinder and have a rectangular cross-section;
3) providing a plurality of ejection slits disposed as a ring around a circumference of the central cylinder and through the outer wall;
4) creating asymmetry in length of the at least for electrode walls that compensates for toroidal curvature and creates a desired shape in electric fields within the trapping volume by using electrodes that have arcuate and planar surfaces, the at least four electrode walls forming a ring around an outer wall of the central cylinder and having a rectangular cross-section;
5) ejecting ions through the plurality of ejection slits; and
6) detecting the ions that are elected into the central cylinder.

29. A system for trapping ions in a multi-layer toroidal ion trap having cylindrical electrodes, said system comprised of:

two RF electrodes forming a top layer or first electrode wall and a bottom layer or second electrode wall of a multi-layer toroidal ion trap having cylindrical electrodes, having a circular ring portion and a linear ion guide that can vary from a position that is perpendicular to the circular ring portion to a position that is tangential;

an AC electrode disposed between the top layer and the bottom layer and forming an outer electrode wall, having a ring portion that is coaxial with the two RF electrodes, and having an inner diameter that is larger than an inner diameter of the two RF electrodes;

a central cylinder that is disposed within the circular ring portion of the two RF electrodes and the AC electrode, and forming an inner electrode wall; and a trapping volume creating by the first electrode wall, the second electrode wall, the inner electrode wall and the outer electrode wall, wherein creating asymmetry in length of the electrode walls compensates for toroidal curvature and creates a desired shape in electric fields within the trapping volume, the electrode walls forming a ring around an outer wall of the central cylinder and having a rectangular cross-section.

30. The system as defined in claim 29 wherein the system is further comprised of a plurality of ejection slits disposed as a ring around a circumference of the central cylinder, wherein the trapping volume is centered on a plurality of ejection slits through the central cylinder.

31. The system as defined in claim 30 wherein the system is further comprised of at least one ion detector disposed at a central axis of the central cylinder, the ion detector detecting ions ejected into the central cylinder through the plurality of ejection slits.

32. The system as defined in claim 31 wherein the system is further comprised of means for applying RF signals to the two RF electrodes and an AC signal to the AC electrode, to thereby separate ions according to mass-to-charge ratios of charged particles and charged particles derived from atoms, molecules, particles, sub-atomic particles and ions.

33. The system as defined in claim 29 wherein the system is further comprised of an ion source for creating and introducing ions into the trapping volume using the linear ion guide.

* * * * *